US005658358A

United States Patent [19]

Chyou et al.

[11] Patent Number: 5,658,358

[45] Date of Patent: *Aug. 19, 1997

[54] FUEL SUPPLY SYSTEM FOR COMBUSTION CHAMBER

[75] Inventors: Yau-Pin Chyou, Taipei, Taiwan; Adnan Eroglu, Untersiggenthal, Switzerland

[73] Assignee: ABB Management Ag, Baden, Switzerland

[ * ] Notice: The term of this patent shall not extend beyond the expiration date of Pat. No. 5,518,311.

[21] Appl. No.: 222,241

[22] Filed: Apr. 4, 1994

[30] Foreign Application Priority Data

Apr. 8, 1993 [CH] Switzerland ..... 1088/93

[51] Int. Cl.[6] ..... B01F 3/02

[52] U.S. Cl. ..... 48/180.1; 60/737; 138/37; 261/78.1; 366/173.1; 366/337

[58] Field of Search ..... 48/180.1; 261/78.1, 261/78.2, 79.1, 79.2; 366/173.1, 173.2, 174.1, 337, 338, 340, 341; 138/37; 431/8, 9, 10, 354, 356; 60/737

[56] References Cited

U.S. PATENT DOCUMENTS

| | | | |
|---|---|---|---|
| 875,175 | 12/1907 | Hess | 48/180.1 |
| 1,312,147 | 8/1919 | Wallwin | 48/180.1 |
| 2,907,557 | 10/1959 | Coanda | 261/78.1 |
| 3,244,221 | 4/1966 | Labino | 48/180.1 |
| 3,829,279 | 8/1974 | Qualley et al. | 48/180.1 |
| 3,835,886 | 9/1974 | Zajac | 48/180.1 |
| 3,879,939 | 4/1975 | Markowski | 60/737 |
| 4,160,640 | 7/1979 | Maeo et al. | 431/9 |
| 4,164,375 | 8/1979 | Allen | 366/337 |
| 4,189,914 | 2/1980 | Marek | 60/737 |
| 4,812,049 | 3/1989 | McCall | 366/174 |
| 4,845,952 | 7/1989 | Beebe | 60/737 |
| 4,951,463 | 8/1990 | Lee et al. | 60/270.1 |
| 4,981,368 | 1/1991 | Smith | 366/340 |
| 5,016,443 | 5/1991 | Shimizu et al. | 60/737 |
| 5,239,831 | 8/1993 | Kuroda et al. | 60/737 |
| 5,267,851 | 12/1993 | Washam et al. | 431/9 |
| 5,292,244 | 3/1994 | Xiong | 431/354 |
| 5,340,306 | 8/1994 | Keller et al. | 431/354 |
| 5,380,088 | 1/1995 | Fleiselli et al. | 366/174 |
| 5,423,608 | 6/1995 | Chyou et al. | 366/337 |
| 5,433,596 | 7/1995 | Dobblng et al. | 431/351 |
| 5,498,155 | 3/1996 | Chyou et al. | 431/359 |
| 5,513,982 | 5/1996 | Althaus et al. | 431/351 |
| 5,518,311 | 5/1996 | Althaus et al. | 366/337 |

FOREIGN PATENT DOCUMENTS

| | | | |
|---|---|---|---|
| 0 520 163 | 12/1992 | European Pat. Off. . | |
| 25 08 665 | 9/1976 | Germany . | |
| 35 20 772 | 12/1986 | Germany . | |
| 3520772 | 12/1986 | Germany | 366/341 |
| 3819899 | 11/1989 | Germany | 366/341 |
| 793325 | 4/1958 | United Kingdom | 60/737 |
| 1 096 624 | 12/1967 | United Kingdom . | |
| 2242734 | 10/1991 | United Kingdom | 431/9 |
| WO8700078 | 1/1987 | WIPO | 366/340 |

*Primary Examiner*—Timothy McMahon
*Attorney, Agent, or Firm*—Burns, Doane, Swecker & Mathis, L.L.P.

[57] ABSTRACT

In a fuel supply system with premixing combustion, a gaseous and/or liquid fuel is introduced as a secondary flow into a gaseous, ducted main flow. The secondary flow has a substantially smaller mass flow than the main flow. The main flow is guided via vortex generators (9) of which a plurality are arranged adjacent to one another over the periphery of the duct (20), through which flow takes place, on at least one duct wall. The secondary flow is fed into the duct (20) in the immediate region of the vortex generators (9). A vortex generator (9) has three surfaces around which flow takes place freely, which surfaces extend in the flow direction, one of them forming the top surface (10) and the two others forming the side surfaces (11, 13). The fuel is fed into the duct from nozzles which are located before, behind or in the vortex generator.

8 Claims, 4 Drawing Sheets

FUEL SUPPLY SYSTEM FOR COMBUSTION CHAMBER

BACKGROUND OF THE INVENTION

1. Field of the Invention

The invention relates to a fuel supply system for a combustion chamber with premixing combustion in which a gaseous and/or liquid fuel is introduced as a secondary flow into a gaseous, ducted main flow, the secondary flow having a substantially smaller mass flow than the main flow and the premixing duct through which flow takes place having curved walls.

2. Discussion of Background

The mixing of fuel into a combustion air flow occurring in a premixing duct takes place, as a rule, by means of the radial introduction of the fuel into the duct by means of cross-jet mixers. The momentum of the fuel, however, is so small that almost complete mixing has only taken place after a distance of approximately 100 duct heights. Venturi mixers are also used. The introduction of fuel via grid arrangements is also known. Finally, the introduction of fuel before special swirlers is also used.

The appliances operating on the basis of cross jets or layer flows either have, as a result, very long mixing lengths or demand high injection momentums. In the case of premixing at high pressure and substoichiometric mixing conditions, the danger exists of flash-back of the flame or even self-ignition of the mixture. Flow separations and dead water zones in the premixing tube, thick boundary layers on the walls or possibly extreme velocity profiles over the cross section through which flow takes place can be the cause for self-ignition in the pipe or form paths by means of which the flame can flash back into the premixing tube from the combustion zone located downstream. It is therefore necessary to pay maximum attention to the geometry of the premixing length.

SUMMARY OF THE INVENTION

Accordingly, one object of the invention is to provide, in a combustion chamber with premixing combustion, a novel measure by means of which thorough mixing of the combustion air and fuel is achieved within the shortest distance with a simultaneously even velocity distribution in the mixing zone. The measure should also be suitable for retrofitting to existing premixing combustion chambers.

This is achieved, in accordance with the invention,

- in that the main flow is guided via vortex generators of which a plurality are arranged adjacent to one another over the periphery of the duct through which flow takes place on at least one duct wall, and in that the secondary flow is fed into the duct in the immediate region of the vortex generators,
- in that a vortex generator has three surfaces around which flow can take place freely, which surfaces extend in the flow direction, one of them forming the top surface and the two others forming the side surfaces,
- in that the side surfaces abut the same duct wall and enclose the V-angle $\alpha$ between them,
- in that a top surface edge extending transverse to the duct through which flow takes place is in contact with the same duct wall as the side walls,
- and in that the longitudinally directed edges of the top surface, which abut the longitudinally directed edges of the side surfaces protruding into the flow duct, extend at an angle of incidence $\theta$ to the duct wall.

Using the novel static mixer, which is represented by the three-dimensional vortex generators, it is possible to achieve extraordinarily short mixing lengths in the combustion chamber with a simultaneously low pressure loss. Rough mixing of the two flows has already been achieved after one complete rotation of the vortex due to the generation of a longitudinal vortex without a recirculation region, whereas fine mixing as a consequence of turbulent flow and molecular diffusion processes is present after a distance which corresponds to a few duct heights.

The advantage of the vortex generators may be seen in their particular simplicity in every respect. The element consisting of three walls around which flow takes place is completely unproblematic from the point of view of manufacture. The top surface can be joined to the two side surfaces in many different ways. The fixing of the element on flat or curved duct walls can also take place by means of simple welds in the case of weldable materials. From the point of view of fluid mechanics, the element has a very low pressure loss when flow takes place around it and it generates vortices without a dead water region. Finally, the element can be cooled in many different ways and with various means because of its generally hollow internal space.

It is appropriate to select the ratio between the height h of the connecting edge of the two side surfaces and the duct height H in such a way that the vortex generated fills the full duct height, or the full height of the part of the duct associated with the vortex generator, immediately downstream of the vortex generator.

It is useful for the two side surfaces enclosing the V-angle $\alpha$ to be arranged symmetrically about an axis of symmetry. Equal-swirl vortices are generated by this means.

If the two side surfaces enclosing the V-angle $\alpha$ form, between them, an at least approximately sharp connecting edge which forms, together with the longitudinal edges of the top surface, a point, the cross section through which flow takes place is almost unimpaired by blockage.

If the sharp connecting edge is the outlet edge of the vortex generator and if it extends at right angles to the duct wall which the side surfaces abut, the non-formation of a wake region is of advantage.

If the axis of symmetry extends parallel to the duct axis and the connecting edge of the two side surfaces forms the downstream edge of the vortex generator whereas, in consequence, the edge of the top surface extending transverse to the duct through which flow takes place forms the edge which the duct flow meets first, then two equal and opposing vortices are generated on one vortex generator. A swirl-neutral flow pattern is present in which the direction of rotation of the two vortices rises in the region of the connecting edge.

Further advantages of the invention, in particular in association with the arrangement of the vortex generators and the introduction of the secondary flow, are given in the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
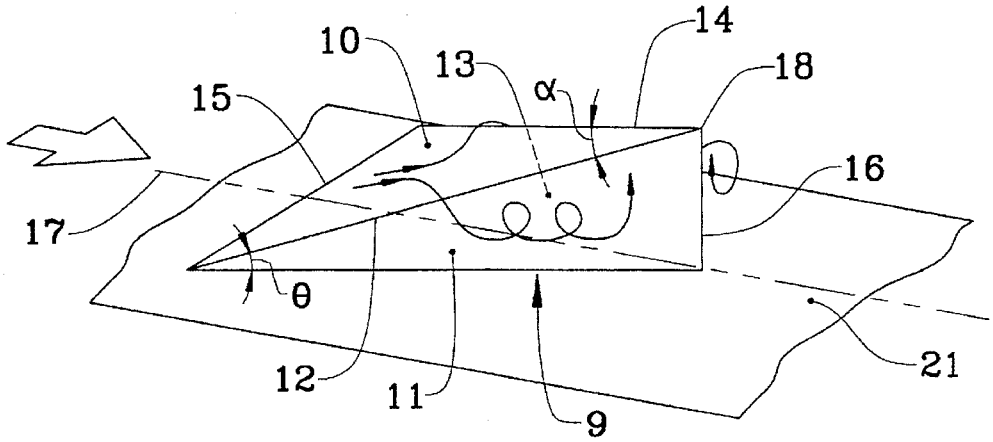
FIG. 1 shows, diagrammatically, a perspective representation of a vortex generator.

Referring now to the drawings, wherein like reference numerals designate identical or corresponding parts throughout the several views, in which the flow direction of the working media is indicated by arrows and in which elements not essential to the invention (such as casings, fastenings, conduit lead-throughs and the like) are omitted, the vortex generator which is essential for the mode of operation of the invention is described first before the actual combustion chamber is considered.

Figure 2:
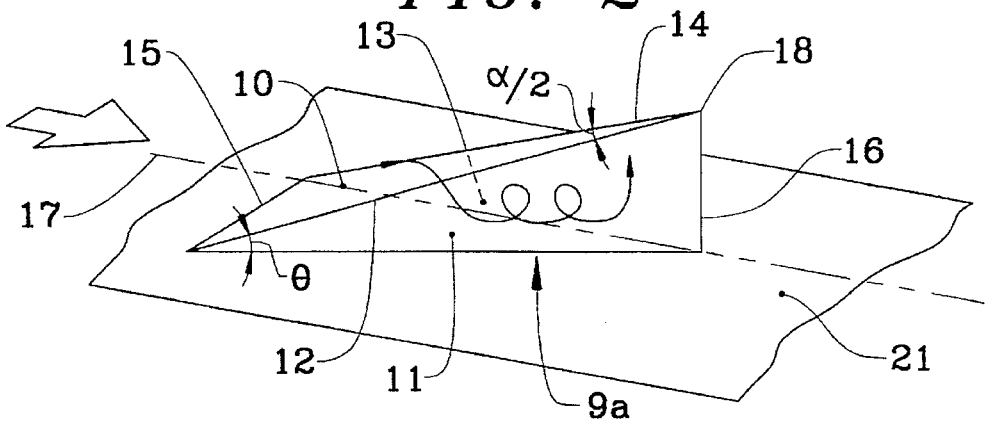
FIG. 2 shows, diagrammatically, an embodiment variant of the vortex generator.
Figure 5:
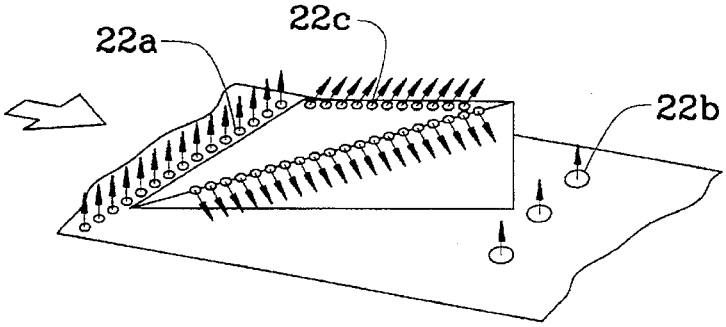
FIG. 5 shows, diagrammatically, a plurality of variants of the secondary flow guidance.

The actual duct, through which there is a main flow symbolized by the large arrow, is not shown in FIGS. 1, 2 and 5. As shown in these figures, a vortex generator consists essentially of three triangular surfaces around which flow takes place freely. These surfaces are a top surface 10 and two side surfaces 11 and 13. These surfaces extend longitudinally at certain angles in the flow direction.

The long sides of the vortex generator side walls, which consist of right-angled triangles, are fixed to a duct wall 21, preferably in a gastight manner. They are oriented in such a way that they form a joint on their narrow sides and enclose a V-angle $\alpha$. The joint is designed as sharp connecting edge 16 and is at right angles to the duct wall 21 which the side surfaces abut. The side surfaces 11, 13 enclosing the V-angle $\alpha$ are symmetrical in FIG. 1 in shape, size and orientation and are arranged on both sides of an axis of symmetry 17. This axis of symmetry 17 has the same direction as the duct axis.

An edge 15 of the top surface 10 has a very narrow configuration and extends transverse to the duct through which flow takes place. This edge is in contact with the same duct wall 21 as the side walls 11, 13. Its longitudinally directed edges 12, 14 abut the longitudinally directed edges of the side surfaces protruding into the flow duct. The top surface extends at an angle of incidence $\theta$ to the duct wall 21. Its longitudinal edges 12, 14 form, together with the connecting edge 16, a point 18.

The vortex generator can also, of course, be provided with a bottom surface by means of which it is fastened to the duct wall 21 in a suitable manner. Such a bottom surface, however, has no relationship to the mode of operation of the element.

In FIG. 1, the connecting edge 16 of the two side surfaces 11, 13 forms the downstream edge of the vortex generator. The edge 15, of the top surface 10, extending transverse to the duct through which flow takes place is therefore the edge which the duct flow meets first.

Figure 4:
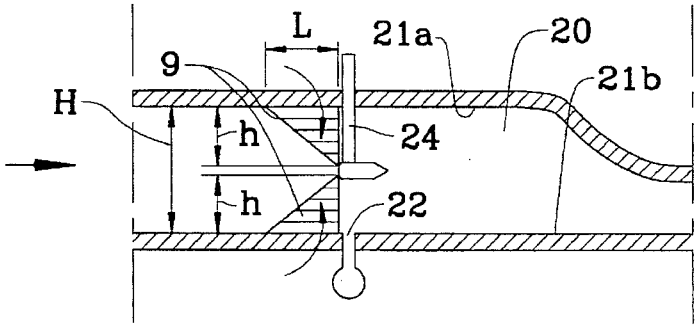
FIG. 4 shows, diagrammatically, a partial longitudinal section through a combustion chamber along the line 4—4 in FIG. 3.

The mode of operation of the vortex generator is as follows. When flow takes place around the edges 12 and 14, the main flow is converted into a pair of opposing vortices. The vortex axes are located in the axis of the main flow. The swirl number and the location of the vortex breakdown, where the latter is desirable at all, are determined by appropriate selection of the angle of incidence $\theta$ and the V-angle $\alpha$. With increasing angles, the vortex strength and the swirl number are increased and the vortex breakdown location moves upstream into the region of the vortex generator itself. These two angles $\theta$ and $\alpha$ are specified, depending on the application, by design requirements and by the process itself. It is then only necessary to match the length L of the element and the height h of the connecting edge 16 (FIG. 4).

On the basis of a vortex generator in accordance with FIG. 1, FIG. 2 shows a so-called "half vortex generator" in which only one of the two side surfaces of the vortex generator 9*a* is provided with a V-angle $\alpha/2$. The other side surface is straight and directed in the flow direction. In contrast to the symmetrical vortex generator, there is only one vortex in this case and it is generated on the arrowed side. In consequence, the field downstream of the vortex generator is not vortex-neutral and a swirl is imposed on the flow.

The vortex generators are mainly used as a mixer of two flows. The main flow, in the form of combustion air, heads toward the transversely directed inlet edges 15 in the arrowed direction. The secondary flow, in the form of a gaseous and/or liquid fuel, has a substantially smaller mass flow than the main flow. It is fed into the main flow in the immediate region of the vortex generators.

The feeding of the gaseous and/or liquid fuel (which has to be mixed into the combustion air) into the flow duct can take place in a variety of ways, as shown in FIG. 5.

As an example, the fuel can flow out into the combustion air via wall holes 22*c* which are arranged in echelon in the longitudinal edges 12 and 14 (or at least in their immediate region). In this case, the fuel is first fed through the duct wall 21 into the hollow inside of the vortex generator, by means which are not shown. From the wall holes 22*c*, it therefore passes directly into the developing vortex which rises in the injection region. There are defined flow relationships present in this case.

The fuel can also be introduced from wall holes 22*a* which are located in the duct wall 21 along the edge 15 of the vortex generator. The injection angle is then selected in such a way that the fuel flows around the top surface of the vortex generator as a film before it is mixed. This "cold" film forms a protective layer for the top surface against a hot main flow. This solution is specially suitable for dual-fuel operation in which both gaseous fuel and liquid fuel are mixed into the main flow and later burned. The liquid fuel, oil in the present case, is then introduced via an individual hole (not shown) opening directly at the edge 15, preferably at the same injection angle as the gas. This oil is also distributed as a protective film over the top surface before its atomization in the vortex. A slot (not shown) can be used in this case also instead of the wall holes 22*b*.

Wall holes 22*b*, through which the fuel is blown into the rising vortex, can also be provided downstream of the vortex generators.

As a departure from the possibilities shown, the fuel can also be introduced from an individual hole which is made in the region of the point 18 of the vortex generator. In this case, the medium is introduced directly into the fully formed vortex and, specifically, likewise into its rising branch.

Finally, it is obvious that all the methods or individual methods can be combined with one another.

Various different possibilities for installing the vortex generators in the premixing space of the combustion chamber are described below.

Figure 3:
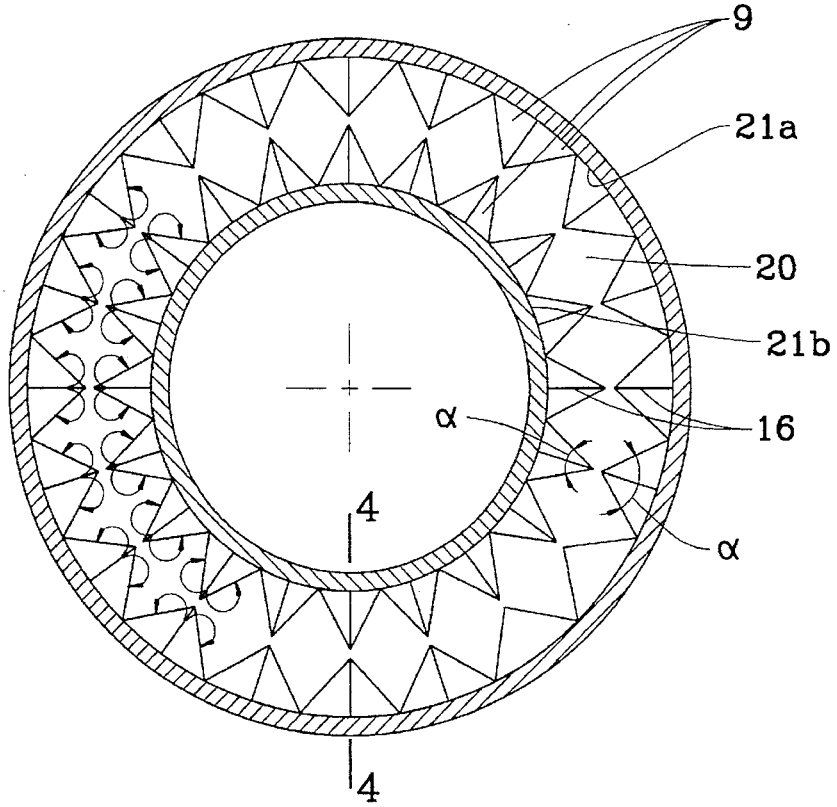
FIG. 3 shows, diagrammatically, the annular combustion chamber of a gas turbine with vortex generators in accordance with FIG. 1 installed.

FIG. 3 shows, in a simplified manner, a combustion chamber with an annular duct 20 through which flow takes place. An equal number of vortex generators in accordance with FIG. 1 are arranged in rows in the peripheral direction on each of the duct walls 21*a* and 21*b* and without free intermediate spaces in such a way that the connecting edges 16 of two opposite vortex generators are located in the same radial. If equal heights h are assumed for the opposite vortex generators, FIG. 3 shows that the vortex generators on the inner duct ring 21*b* will have a smaller V-angle $\alpha$. It may be recognized from the longitudinal section in FIG. 4 that compensation could be provided for this by a larger angle of incidence $\theta$ if equal-swirl vortices are desired in the inner and outer annular cross sections. In this solution, as is indicated in FIG. 3, two vortex pairs are generated, each with small vortices, and this leads to a shorter mixing length.

As shown in FIG. 4, the liquid fuel is introduced in this case via a central fuel lance 24 whose opening is located downstream of the vortex generators 9 in the region of their point 18. The introduction of the gaseous fuel takes place in two ways in this example, in accordance with the methods described in FIG. 5. On the one hand, as is indicated by arrows, it is introduced via wall holes in the vortex generators themselves and, on the other hand, it is introduced via wall holes 22*b* in the duct wall 21*b* behind the vortex generators. These wall holes are supplied by a ring main.

The fuel introduced is entrained by the vortices and mixed with the main flow. It follows the helical path of the vortices and is evenly and finely distributed in the chamber downstream of the vortices. This reduces the danger of jets impinging on the opposite wall with the formation of so-called "hot spots"—as occurs in the case of radial introduction of fuel into an unswirled flow, as mentioned at the beginning.

Because the main mixing process takes place in the vortices and is, to a large extent, insensitive to the momentum with which the secondary flow is introduced, the fuel injection can be kept flexible and matched to other boundary conditions. As an example, the momentum with which it is introduced can be kept constant over the whole of the load range. Because the mixing is determined by the geometry of the vortex generators and not by the machine load—the gas turbine power in the present example—the burner configured in this way operates in an optimum manner even under part-load conditions. The combustion process is optimized by matching the ignition delay period of the fuel to the mixing time of the vortices; this ensures minimized emissions.

Furthermore, the effective mixing produces a good temperature profile over the cross section through which flow takes place and, in addition, reduces the possibility of thermoacoustic instability appearing. The vortex generators act as a damping measure against thermoacoustic vibrations by their presence alone.

In the solutions represented in FIGS. 6 to 8, the gaseous fuel can be introduced via wall holes which are fed from ring mains fitted within the duct. It is, of course, equally possible—as a departure from the radially introduced lance represented in FIG. 4—to provide central lances for liquid fuel with a plurality of them distributed over the periphery of the annular duct.

Figure 6A:
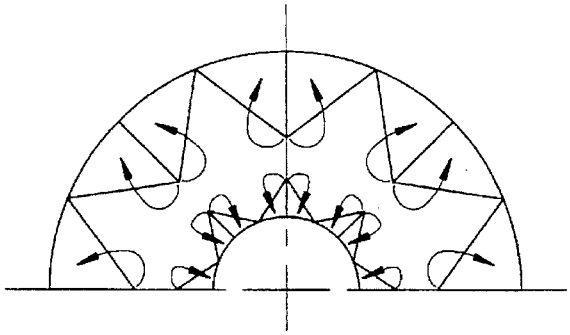
FIGS. 6*a, b* shows, diagrammatically, a second arrangement variant of the vortex generators in an annular combustion chamber.
Figure 6B:
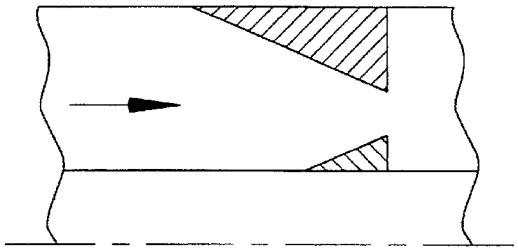

FIGS. 6*a* and 6*b* shows a configuration similar to FIG. 3 but with smaller annular wall radii and a large duct height. Because of this, the heights of the mutually opposite vortex generators are very different.

As a rule, the height h of the connecting edge 16 will be matched to the duct height H, or the height of the duct part which is associated with the vortex generator, in such a way that the vortex generated has already reached such a size immediately downstream of the vortex generator that the full duct height H is filled. This leads to an even velocity distribution in the cross section subjected to the flow. A further criterion which can have an influence on the ratio h/H to be selected is the pressure drop which occurs when flow takes place around the vortex generator. It is obvious that as the ratio h/H increases, the pressure loss coefficient also increases.

Figure 7A:
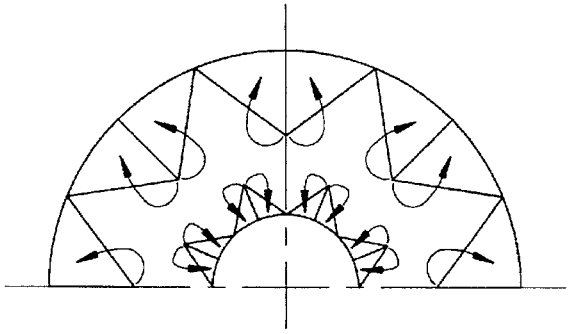
FIGS. 7*a, b* shows, diagrammatically, a third arrangement variant of the vortex generators in an annular combustion chamber.
Figure 7B:
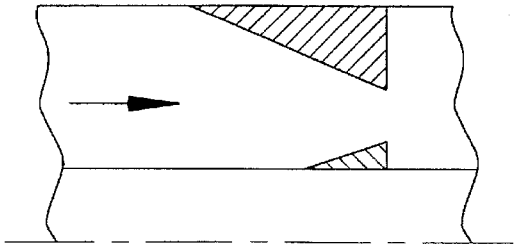

In the vortex generators shown in FIGS. 7*a* and 7*b* the connecting edges of two opposite vortex generators are offset by half a pitch. This alters the vortex structure downstream of the vortex generators in such a way that the vortices generated on the same side have the same direction of rotation and, under certain circumstances, merge to form a large vortex which fills the complete duct cross section in the corresponding angular sector. By this means, the mixing quality can be still further improved, on the one hand, and an increased vortex life can be achieved, on the other. This solution offers the possibility (not shown) of increasing the height of the inner vortex generators so that their point can engage between the side walls of the two opposite vortex generators.

Figure 8A:
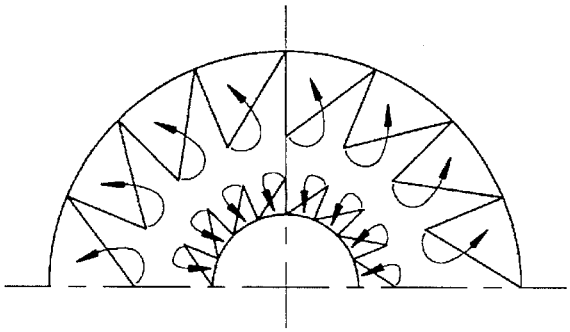
FIGS. 8*a, b* shows, diagrammatically, a fourth arrangement variant of the vortex generators in accordance with FIG. 2 in an annular combustion chamber.
Figure 8B:
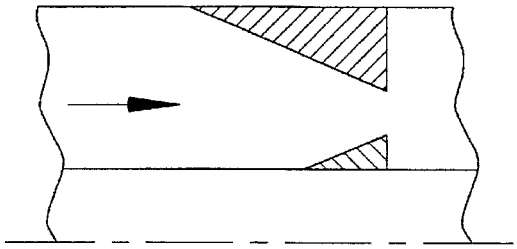

In FIGS. 8*a* and 8*b* so-called "half" vortex generators 9*a* are arranged in a row in the peripheral direction on both annular walls. As may be recognized from the arrows, the individual vortices—which all have the same direction of rotation—combine to form a large rotating vortex acting on the complete duct.

The three arrangements described below are extremely suitable for initial installation or as a retrofit measure in premixing chambers in which the duct 20 through which flow takes place is of circular cross section. The previous nozzle grids or mixing tubes for the gaseous fuel are simply replaced by a ring main 25 arranged inside the premixing chamber and the slots or holes 22*e* before the vortex generators are fed from this ring main 25. A central fuel lance could also be arranged in this composite.

Figure 9A:
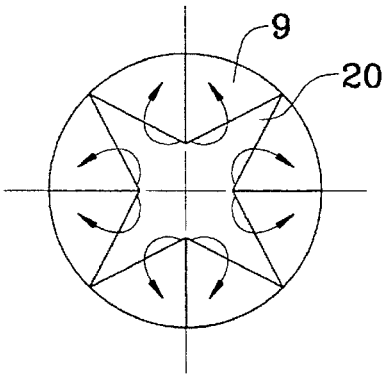
FIGS. 9*a, b* shows, diagrammatically, a cylindrical combustion chamber with a first arrangement variant of the vortex generators.
Figure 9B:
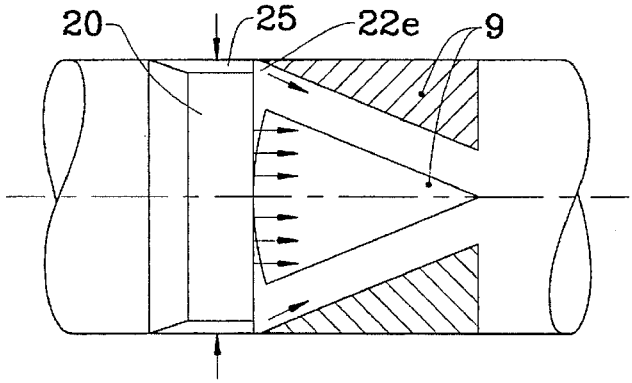

As shown in FIGS. 9*a* and 9*b* four vortex generators 9 are arranged in a row in the peripheral direction on the wall 21*a* in such a way that no intermediate spaces are left free on the duct wall. The mode of operation of the elements in such a composite corresponds to that of the outer vortex generators in FIG. 3.

Figure 10A:
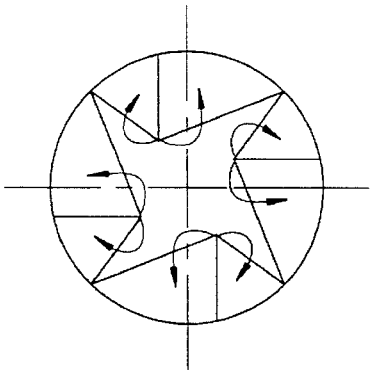
FIGS. 10*a, b* shows, diagrammatically, a cylindrical combustion chamber with a second arrangement variant of the vortex generators.
Figure 10B:
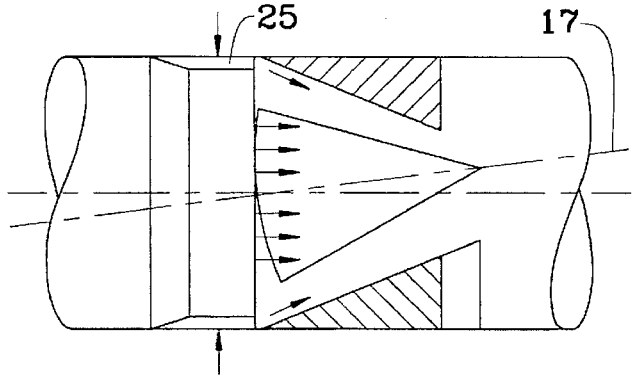

In FIGS. 10*a* and 10*b* the axis of symmetry 17 of the vortex generators 9 extends, for the same basic arrangement of the latter, obliquely to the duct axis. The two side surfaces therefore have a different V-angle relative to the main flow. Vortices with a different swirl number therefore occur on the two sides of the vortex generator. This leads to swirl adhering to the flow downstream of the elements.

Figure 11A:
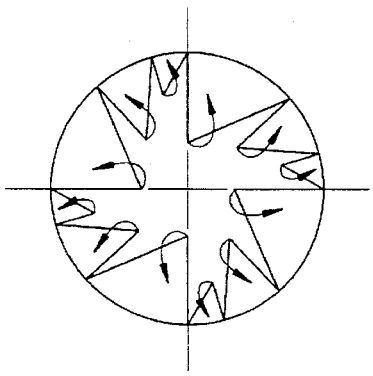
FIGS. 11*a, b* shows, diagrammatically, a cylindrical combustion chamber with an arrangement variant of the vortex generators in accordance with FIG. 2.
Figure 11B:
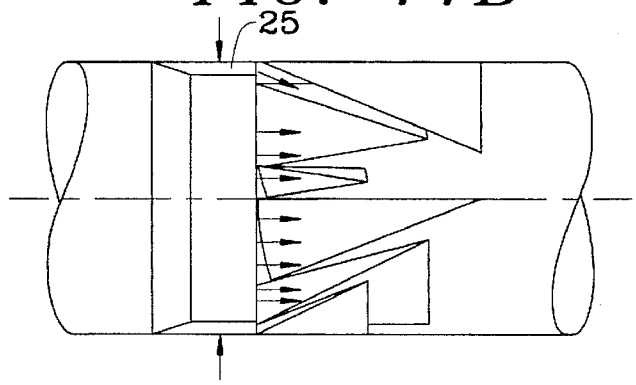

The whole of the cross section through which flow takes place is swirled in the solution in accordance with FIGS. 11*a* and 11*b*. The arrangement consists of four groups, each with three vortex generators 9*a* in accordance with FIG. 2. The three vortex generators in one group are provided with increasing height. All the vortices generated have the same rotation.

Figure 12A:
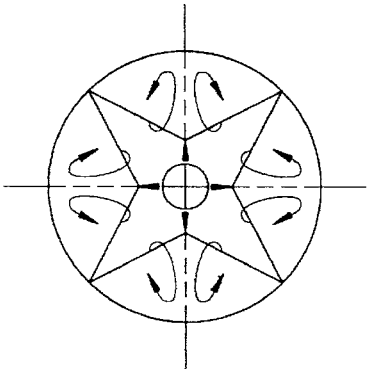
FIGS. 12*a, b* shows, diagrammatically, an arrangement variant as in FIG. 9 with a central fuel feed.
Figure 12B:
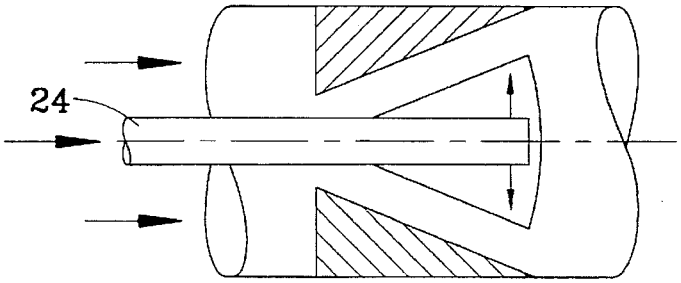

In FIGS. 12*a* and 12*b* four Vortex generators are again arranged over the periphery. As a departure from the position shown in FIG. 9, however, the respective connecting edge 16 is now the position which the duct flow meets first. The elements are rotated by 180° as compared with FIG. 9. As may be recognized from the representation, the two opposing vortices have changed their direction of rotation. They rotate along above the top surface of the vortex generator and tend towards the wall of which the vortex generator is mounted. This solution is intrinsically suitable for the installation of a central lance 24 by means of which the fuel is introduced into the radials in which the axes of symmetry of the vortex generators extend. The fuel passes directly into the vortices rotating towards the wall.

Figure 13A:
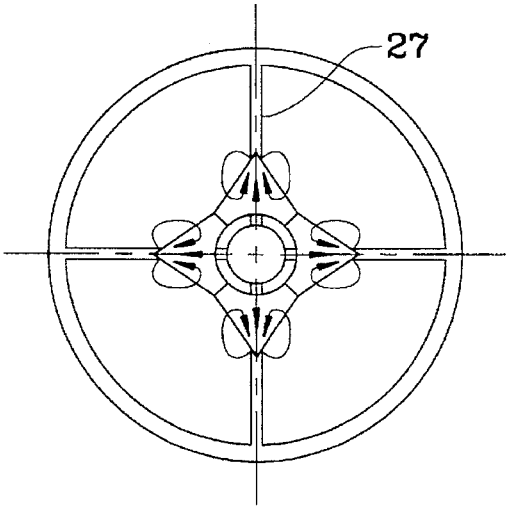
FIGS. 13*a, b* shows, diagrammatically, a fuel lance equipped with vortex generators.
Figure 13B:
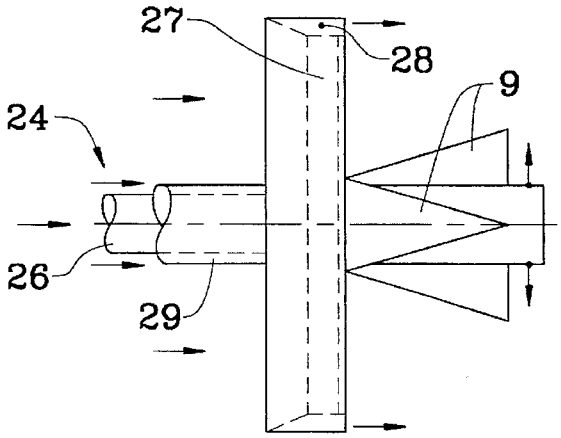

FIGS. 13*a* and 13*b*, finally, shows a variant with vortex generators 9 which are extremely suitable as an exchange unit in cylindrical premixing chambers. In addition, it is designed for dual-fuel operation, i.e. both liquid and gaseous fuel can be mixed into the combustion air. The axial kit which can be introduced into the premixing tube (not shown) consists of a central lance 24 which is provided with vortex generators 9 on its end. The liquid fuel passes, via an oil conduit 26 arranged in the central lance 24, to the injection head from which it is injected into the duct via nozzles. The nozzles are directed, in accordance with the arrowed direction, into the line of symmetry of the vortex generators. In this way, the fuel is taken up by the rising vortices. The gaseous fuel, which is likewise 1 the central lance, passes via hollow ribs 27 into a gas ring 28 by means of which the system is centered and fixed in the tube. The fuel is added to the main flow from this gas ring 28.

The invention is not, of course, limited to the examples described and shown. With respect to the arrangement of the vortex generators in the composite, many combinations are possible without leaving the framework of the invention. The introduction of the secondary flow into the main flow can also be under-taken in a variety of ways. The variant of FIG. 9, for example, is obviously likewise suitable for use in combustion chambers of the "can" type.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fuel supply system with premixing combustion in which at least one of a gaseous and liquid fuel is introduced as a secondary flow into a gaseous, ducted main flow, the secondary flow having a substantially smaller mass flow than the main flow, the system comprising:

a premixing duct having curved walls, for guiding a main flow in a flow direction;

a plurality of vortex generators for generating vortices in the main flow, the vortex generators positioned adjacent to one another over a periphery of the premixing duct on at least one of said premixing duct walls; and means for introducing fuel as a secondary flow into the premixing duct in an immediate region of the vortex generators, wherein each vortex generator has three surfaces around which flow takes place freely, which surfaces extend in the flow direction, a first surface forming a top surface and a second surface and a third surface forming side surfaces, wherein each of the side surfaces has a bottom edge abutting said premixing duct wall and an edge perpendicular to the flow direction, the perpendicular edges abutting at a connecting edge, and the side surfaces defining an acute angle about the connecting edge, wherein the top surface has an edge extending transverse to the flow direction in contact with said premixing duct wall, and wherein the top surface has longitudinally directed edges which abut longitudinally directed edges of the side surfaces protruding into the premixing duct, the top surface being disposed at an angle of incidence to said premixing duct wall.

2. The fuel supply system as claimed in claim 1, wherein the means for introducing a fuel is a central fuel lance having openings located in a plane located immediately downstream of the plurality of vortex generators in the flow direction.

3. The fuel supply system as claimed in claim 1, wherein the vortex generators are disposed so that the side surfaces are arranged symmetrically about an axis coinciding with the flow direction of the premixing duct.

4. The fuel supply system as claimed in claim 1, wherein each vortex generator is shaped so that the connecting edge and the longitudinally directed edges of the top surface form a point, and wherein the connecting edge extends substantially perpendicularly to the at least one premixing duct wall.

5. The fuel supply system as claimed in claim 4, wherein the longitudinally directed edges of the top surface and longitudinally directed edges of the side surfaces meet to form a substantially V-shaped profile.

6. The fuel supply system as claimed in claim 4, wherein each vortex generator is positioned symmetrically about an axis coinciding with the flow direction passing through the connecting edge, the connecting edge is disposed as a downstream edge of the vortex generator and the top surface edge extending transverse to the premixing duct flow direction is an upstream edge.

7. The fuel supply system as claimed in claim 1, wherein a ratio of a height of the vortex generators measured along the connecting edge to a premixing duct height measured parallel to the connecting edge is selected so that a vortex generated fills at least one of the premixing duct height and a height of a duct part in which the vortex generators are disposed, immediately downstream of the vortex generators.

8. The fuel supply system as claimed in claim 3, wherein the premixing duct is annular having an inner annular wall and an outer annular wall and wherein an equal plurality of vortex generators are arranged in a row in a peripheral direction both on the outer annular wall and on the inner annular wall in opposing relationship, the connecting edges of oppositely located vortex generators being in alignment.

* * * * *